US010469959B2

(12) United States Patent
Nielsen et al.

(10) Patent No.: US 10,469,959 B2
(45) Date of Patent: Nov. 5, 2019

(54) METHOD OF OPERATING A HEARING AID SYSTEM AND A HEARING AID SYSTEM

(71) Applicant: WIDEX A/S, Lynge (DK)

(72) Inventors: Jens Brehm Bagger Nielsen, Ballerup (DK); Thomas Bo Elmedyb, Herlev (DK); Kristian Timm Andersen, Lyngby (DK)

(73) Assignee: Widex A/S, Lynge (DK)

( * ) Notice: Subject to any disclaimer, the term of this patent is extended or adjusted under 35 U.S.C. 154(b) by 0 days.

(21) Appl. No.: 15/842,155

(22) Filed: Dec. 14, 2017

(65) Prior Publication Data

US 2018/0109882 A1 Apr. 19, 2018

Related U.S. Application Data

(63) Continuation of application No. PCT/EP2015/063843, filed on Jun. 19, 2015.

(51) Int. Cl.
*H04R 25/00* (2006.01)

(52) U.S. Cl.
CPC ..... *H04R 25/407* (2013.01); *H04R 25/405* (2013.01); *H04R 25/453* (2013.01); *H04R 25/505* (2013.01); *H04R 25/70* (2013.01); *H04R 2225/41* (2013.01); *H04R 2225/43* (2013.01); *H04R 2225/55* (2013.01)

(58) Field of Classification Search
CPC ..... H04R 25/00
USPC ..... 381/312, 316
See application file for complete search history.

(56) References Cited

U.S. PATENT DOCUMENTS 6,236,731 B1 * 5/2001 Brennan ..... H03H 17/0266 381/312
2003/0093269 A1 5/2003 Attias et al.
2005/0047609 A1 * 3/2005 Buchner ..... H04M 9/082 381/66
2007/0055508 A1 * 3/2007 Zhao ..... H04R 25/55 704/226
2011/0103613 A1 * 5/2011 Van Der Werf ..... H04R 25/453 381/93

FOREIGN PATENT DOCUMENTS

WO 2009/124550 A1 10/2009
WO 2014/198332 A1 12/2014

OTHER PUBLICATIONS

Dong-Yan Huang et al., "Maximum a Posteriori based Adaptive Algorithms," Conference Record of the Forty-First Asilomar Conference on Signals, Systems & Computers, IEEE, Nov. 4-7, 2007, pp. 1628-1632.
International Search Report of PCT/EP2015/063843 dated Feb. 26, 2016.

* cited by examiner

*Primary Examiner* — Suhan Ni
(74) *Attorney, Agent, or Firm* — Sughrue Mion, PLLC

(57) ABSTRACT

A method of operating a hearing aid system (100, 200, 400, 500) having an adaptive filter (103, 213, 404, 503). The invention also provides a hearing aid system (100, 200, 400, 500) adapted for carrying out such a method and a computer-readable storage medium having computer-executable instructions, which when executed carries out the method.

24 Claims, 3 Drawing Sheets

METHOD OF OPERATING A HEARING AID SYSTEM AND A HEARING AID SYSTEM

CROSS REFERENCE TO RELATED APPLICATIONS

This application is a Continuation of International Application No. PCT/EP2015/063843 filed Jun. 19, 2015, the contents of which are incorporated herein by reference in its entirety.

The present invention relates to a method of operating a hearing aid system having an adaptive filter. The present invention also relates to a hearing aid system adapted to carry out said method and to a computer-readable storage medium having computer-executable instructions, which when executed carries out the method.

BACKGROUND OF THE INVENTION

Generally a hearing aid system according to the invention is understood as meaning any device which provides an output signal that can be perceived as an acoustic signal by a user or contributes to providing such an output signal, and which has means which are customized to compensate for an individual hearing loss of the user or contribute to compensating for the hearing loss of the user. They are, in particular, hearing aids which can be worn on the body or by the ear, in particular on or in the ear, and which can be fully or partially implanted. However, those devices whose main aim is not to compensate for a hearing loss but which have, however, measures for compensating for an individual hearing loss are also concomitantly included, for example consumer electronic devices including mobile phones, televisions, hi-fi systems, MP3 players and mobile health care devices comprising an electrical-acoustical output transducer which may also be denoted hearables or wearables.

Within the present context a traditional hearing aid can be understood as a small, battery-powered, microelectronic device designed to be worn behind or in the human ear by a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear.

Within the present context a hearing aid system may comprise a single hearing aid (a so called monaural hearing aid system) or comprise two hearing aids, one for each ear of the hearing aid user (a so called binaural hearing aid system). Furthermore the hearing aid system may comprise an external computing device, such as a smart phone having software applications adapted to interact with other devices of the hearing aid system. Thus within the present context the term "hearing aid system device" may denote a hearing aid or an external computing device.

The mechanical design of hearing aids has developed into a number of general categories. As the name suggests, Behind-The-Ear (BTE) hearing aids are worn behind the ear. To be more precise, an electronics unit comprising a housing containing the major electronics parts thereof is worn behind the ear. An earpiece for emitting sound to the hearing aid user is worn in the ear, e.g. in the concha or the ear canal. In a traditional BTE hearing aid, a sound tube is used to convey sound from the output transducer, which in hearing aid terminology is normally referred to as the receiver, located in the housing of the electronics unit and to the ear canal. In some modern types of hearing aids a conducting member comprising electrical conductors conveys an electric signal from the housing and to a receiver placed in the earpiece in the ear. Such hearing aids are commonly referred to as Receiver-In-The-Ear (RITE) hearing aids. In a specific type of RITE hearing aids the receiver is placed inside the ear canal. This category is sometimes referred to as Receiver-In-Canal (RIC) hearing aids.

In-The-Ear (ITE) hearing aids are designed for arrangement in the ear, normally in the funnel-shaped outer part of the ear canal. In a specific type of ITE hearing aids the hearing aid is placed substantially inside the ear canal. This category is sometimes referred to as Completely-In-Canal (CIC) hearing aids. This type of hearing aid requires an especially compact design in order to allow it to be arranged in the ear canal, while accommodating the components necessary for operation of the hearing aid. Hearing loss of a hearing impaired person is quite often frequency-dependent. This means that the hearing loss of the person varies depending on the frequency. Therefore, when compensating for hearing losses, it can be advantageous to utilize frequency-dependent amplification. Hearing aids therefore often provide to split an input sound signal received by an input transducer of the hearing aid, into various frequency intervals, also called frequency bands, which are independently processed. In this way it is possible to adjust the input sound signal of each frequency band individually to account for the hearing loss in respective frequency bands. The frequency dependent adjustment is normally done by implementing a band split filter and compressors for each of the frequency bands, so-called band split compressors, which may be summarized to a multi-band compressor. In this way it is possible to adjust the gain individually in each frequency band depending on the hearing loss as well as the input level of the input sound signal in a specific frequency range. For example, a band split compressor may provide a higher gain for a soft sound than for a loud sound in its frequency band.

It is well known within the art of hearing aid systems to apply an adaptive filter for a multitude of different purposes such as noise suppression and acoustic feedback cancellation.

EP-B1-2454891 discloses a hearing aid system comprising an adaptive filter that is set up to receive as input signal a signal from a first hearing aid system microphone and provide as output signal a linear combination of previous samples of the input signal, wherein said output signal is set up to resemble a signal from a second hearing aid system microphone as much as possible, whereby wind noise induced in the microphones may be suppressed. Thus if:

- the signal from the first hearing aid system microphone is denoted x(n) and a first set of signal samples consequently may be denoted $x_n=[x_n, x_{n-1}, x_{n-2}, \ldots, x_{n-N-1}]^T$ wherein n is a time index,
- the adaptive filter has N coefficients that are denoted $w=[w_1, w_2, \ldots, w_N]^T$,
- the signal from the second hearing aid system microphone is denoted d(n), then the adaptive filter is set up to operate in accordance with the formula:

$$d_n=w_n^T x_n+\varepsilon,$$

wherein ε represents noise comprised in the two microphone signals.

WO-A1-2014198332 discloses a hearing aid system comprising an adaptive filter that is set up to receive as input signal a signal from a first microphone of a first hearing aid of the hearing aid system and provide as output signal a linear combination of previous samples of the input signal, wherein said output signal is set up to resemble a signal from a second microphone of a second hearing aid of the hearing aid system as much as possible, wherein the difference between the output signal and the signal from the second microphone is used to estimate the noise level and wherein the noise level estimate is used as input for subsequent algorithms to be applied in order to suppress noise in the microphone signals. Thus if:

the signal from the first microphone is denoted x(n) and the signal from the second microphone is denoted d(n), then the adaptive filter is also in this case set up to operate in accordance with the formula:

$$d_n = w_n^T x_n + \varepsilon,$$

wherein ε represents the estimation error that may be used to estimate the noise and wherein the noise estimate is used for improving the subsequent noise suppression in the hearing aid system. In the following ε may also be construed to represent noise generally whereby the term noise is given a relatively broad interpretation in so far that it includes the adaptive filter estimation error.

There is therefore a need in the art to improve the performance of adaptive filters. In one aspect performance may be increased by minimizing the occurrence of so called artefacts introduced by the adaptive filtering. The occurrence of artefacts may especially be a problem when an adaptive filter has to react fast to sudden changes in the input signal or the desired signal.

It is therefore a feature of the present invention to provide a method of operating a hearing aid system that minimizes the occurrence of artefacts.

It is another feature of the present invention to provide a hearing aid system adapted to provide a method of operating a hearing aid system that minimizes the occurrence of artefacts.

SUMMARY OF THE INVENTION

The invention, in a first aspect, provides a method of operating a hearing aid system comprising the steps of: providing an adaptive filter with N adaptive filter coefficients; providing a first set of input signal samples; providing at least one second signal sample representing a desired signal; filtering the first set of signal samples in the adaptive filter, in accordance with the formula: $d_n = X_n w_n^T + \varepsilon$, wherein $d_n$ is a vector or a scalar comprising the at least one second signal sample representing the desired signal, wherein $w_n$ is a vector holding the adaptive filter coefficients, wherein $X_n$ is a matrix or a vector comprising the first set of input signal samples, wherein ε represents noise and wherein n is a time index; selecting a posterior distribution given by $p(w_n | w_{n-1}, d_n)$; determining the optimum setting of the adaptive filter coefficients as the setting that maximizes the posterior distribution; and selecting the optimum setting of the adaptive filter coefficients when updating the adaptive filter.

This provides an improved method of operating a hearing aid system with respect to the amount of acoustical artefacts due to various types of adaptive filtering in the hearing aid system.

The invention, in a second aspect, provides a non-transient computer readable storage medium having computer-executable instructions, which when executed carries out the method described above.

The invention, in a third aspect, provides a hearing aid system comprising: an adaptive filter having N adaptive filter coefficients; an adaptive filter estimator configured to control the adaptive filter setting by determining the values of the adaptive filter coefficients, wherein the adaptive filter estimator comprises: a first memory holding a transition covariance matrix; a second memory holding a prior covariance matrix; a third memory holding an estimate of a noise standard deviation; a fourth memory holding a prior mean of the adaptive filter coefficients; an algorithm that determines the values of the adaptive filter coefficients based on a closed form expression that uses as variables: a set of samples of a digital input signal; at least one sample of a digital desired signal, and the contents of the first, second, third and fourth memories, and wherein the closed form expression for determining the values of the adaptive filter coefficients is derived using Bayes rule.

This provides a hearing aid system with improved means for operating a hearing aid system.

Further advantageous features appear from the dependent claims.

Still other features of the present invention will become apparent to those skilled in the art from the following description wherein embodiments of the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

Within the present context the term "posterior" represents a distribution of model parameters given observed data, the term "likelihood" represents a distribution of observed data given model parameters, the term "prior" represents a distribution of model parameters and the term "marginal likelihood" (which may also be denoted "evidence") represents a distribution of observed data, wherein the term "model parameters" represents an adaptive filter setting, i.e. the adaptive filter coefficients and wherein the term "observed data" represents a desired signal that the adaptive filter seeks to adapt to.

However, in the following the terms posterior, likelihood, prior and marginal likelihood may be used without explicitly referring to the fact that they represent a distribution and in other cases the distribution may be denoted a probability distribution, despite that the correct term in fact may be probability density function.

Figure 1:
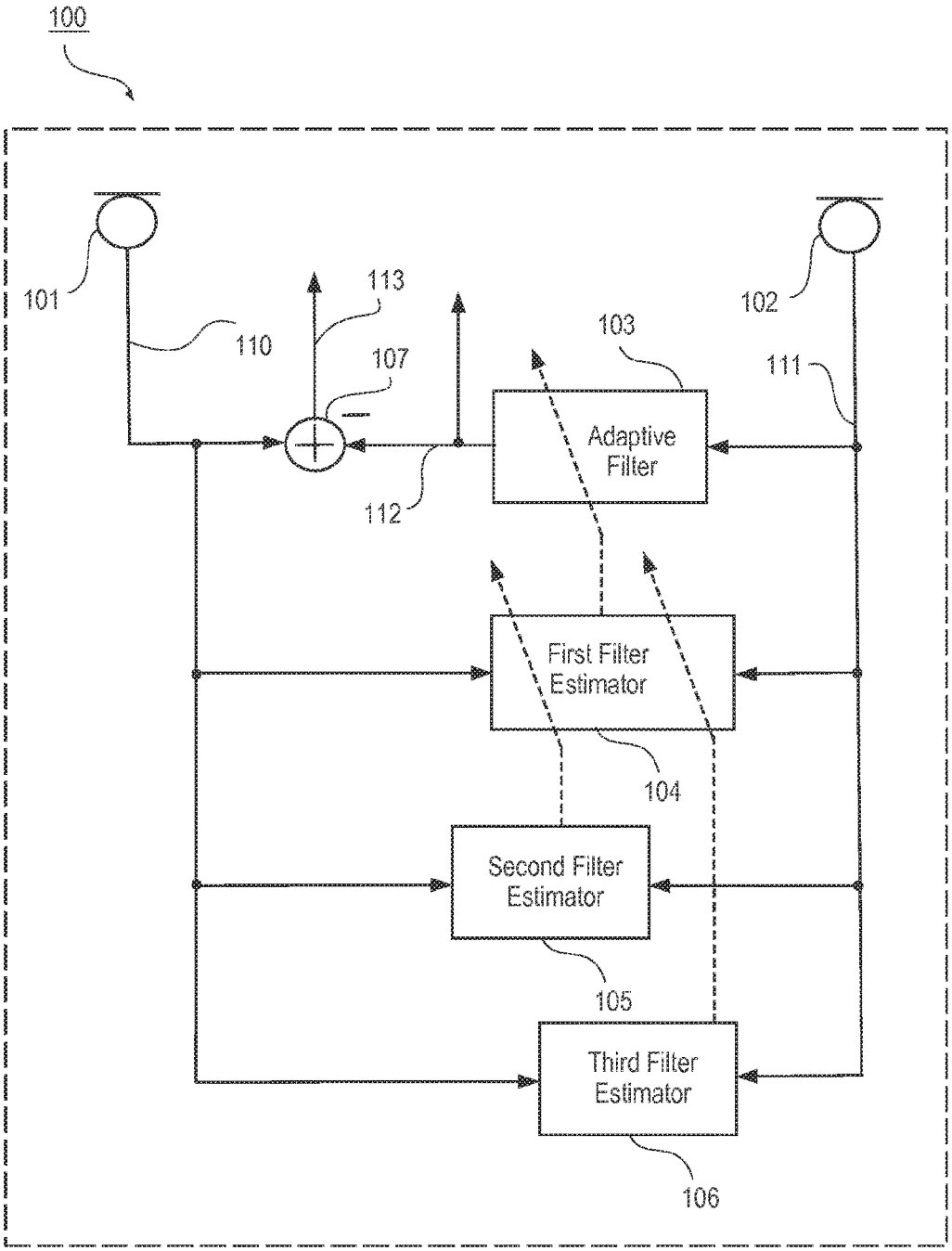
FIG. 1 illustrates highly schematically a selected part of a hearing aid system according to an embodiment of the invention.

Reference is first made to FIG. 1, which illustrates highly schematically a selected part of a hearing aid system 100 according to an embodiment of the invention.

The selected part of the hearing aid system 100 comprises a first acoustical-electrical input transducer 101, i.e. a microphone, a second acoustical-electrical input transducer 102, an adaptive filter 103, a first adaptive filter estimator 104, a second adaptive filter estimator 105, a third adaptive filter estimator 106 and a summing unit 107.

According to the embodiment of FIG. 1 the microphones 101 and 102 provide analog electrical signals that are converted into a first digital input signal 110 and a second digital input signal 111 respectively by analog-digital converters (not shown). However, in the following, the term digital input signal may be used interchangeably with the term input signal and the same is true for all other signals referred to in that they may or may not be specifically denoted as digital signals.

The first digital input signal 110 is branched, whereby it is provided to a first input of the summing unit 107 and to the first, second and third adaptive filter estimators 104, 105 and 106. The second digital input signal 111 is also branched, whereby it is provided to the adaptive filter 103 as input signal and to the first, second and third adaptive filter estimators 104, 105 and 106. The adaptive filter 103 provides an output signal 112 that is provided to a second input of the summing unit 107. The output signal 112 contains an estimate of the correlated part of the digital input signal 110. Finally the summing unit 107 provides a summing unit output signal 113 that is formed by subtracting the adaptive filter output signal 112 from the first digital input signal 110, whereby the output signal 113 can be used to estimate the uncorrelated part of the first digital input signal. Thus the level of the output signal 113 may be used as an estimate of the noise in the signal 110 received by the microphone 101.

However, according to the embodiment of FIG. 1 the adaptive filter output signal 112 is provided to the remaining parts of the hearing aid system i.e. to a digital signal processor configured to provide an output signal for an acoustic output transducer, wherein the output signal from the digital signal processor is adapted to alleviate a hearing deficit of an individual hearing aid user. Thus according to the present embodiment the remaining parts of the hearing aid system comprise amplification means adapted to alleviate a hearing impairment. In variations the remaining parts may also comprise additional noise reduction means. For reasons of clarity these remaining parts of the hearing aid systems are not shown in FIG. 1.

According to another variation of the embodiment of FIG. 1 the summing unit output signal 113 may also be provided to at least one of the filter estimators 104, 105 and 106, e.g. in the case where a traditional gradient based algorithm such as the LMS algorithm is implemented.

According to the embodiment of FIG. 1 the adaptive filter is configured to operate as a linear prediction filter, wherein the first digital input signal 110 constitutes a noisy observation of the desired signal and in the following therefore may be denoted $d_n$ with n being a time index, wherein the second digital input signal 111 is provided as input signal to the adaptive filter 103, wherein the adaptive filter 103 has N adaptive filter coefficients, that may be given as a vector $w_n=[w_1, w_2, \ldots, w_N]^T$ and wherein the adaptive filter 103 seeks to predict the desired signal $d_n$ based on a set of recent samples of the second digital input signal that may be given as a vector $x_n=[x_n, x_{n-1}, x_{n-2}, \ldots, x_{n-N-1}]^T$ in accordance with the formula:

$$d_n=w_n^T x_n+\varepsilon,$$

wherein ε represents the uncorrelated noise from the first and second digital input signal, i.e. the summing unit output signal 113.

According to the present embodiment ε is assumed to be an independent and identically distributed (i.i.d.) random variable with a Gaussian distribution, hereby implying:

$$\epsilon \sim \mathcal{N}(0,\sigma^2).$$

However, in variations other distributions may be assumed for the noise such as various super Gaussian distributions like the student's t-distribution and the Laplace distribution, or such as various bounded distributions like e.g. a truncated Gaussian distribution, beta distribution or Gamma distribution.

In another variation ε is not assumed to be an independent and identically distributed (i.i.d.) random variable. The i.i.d. assumption is only reasonable when the observational noise from one sample to another is uncorrelated. Hence, in situations where ε represents correlated noise, it is better to omit the i.i.d. assumption. Basically the i.i.d assumption allows the so called product rule to be applied and this may in some cases lead to less complex mathematical expressions whereby the processing requirements may be relieved.

In further variations of the present embodiment ε is a random variable that represents the estimation error of the adaptive filter or effects, such as non-linear effects, that the adaptive filter is not set up to model.

In other variations of the present embodiment the adaptive filter is used to predict an unknown underlying process f(x) and in this case the same formula as given above may be applied:

$$d_n=w_n^T x_n+\varepsilon$$

wherein:

$$f(x)=w^T x$$

Thus in this case $d_n$ represents a noisy observation of the unknown underlying process f(x).

Thus within the present context the term "desired signal" may generally represent any type of desired signal but may also represent a noisy observation of an unknown process that it is desirable to model.

Similarly the term "noise" may be used to characterize the variable ε, despite that ε may also represent estimation errors of the adaptive filter.

According to the present embodiment, the single sample of the desired signal $d_n$ is extended to comprise a set of M recent signal samples that may be given as a vector $d_n=[d_n, d_{n-1}, \ldots, d_{n-M-1}]^T$ and similarly the matrix $X_n$ holds the M recent vectors of input signal samples and hereby given as:

$$X_n=\begin{bmatrix} x_n & \cdots & x_{n-N-1} \\ \vdots & \ddots & \vdots \\ x_{n-M-1} & \cdots & x_{n-M-N-2} \end{bmatrix}$$

and our linear model thus becomes:

$$d_n=X_n w_n+\epsilon$$

and the noise may be expressed as:

$$\epsilon \cdot \mathcal{N}(0,\sigma^2 I)$$

Where I denotes the identity matrix.

By using a plurality of signal samples of the desired signal a processing with fewer processing artefacts may be obtained for some sound environments but typically this comes at the cost of higher processing requirements. Thus as one example this type of processing will typically be advantageous when processing vowels.

By using only a single signal sample of the desired signal, on the other hand, the processing will be better suited for avoiding processing artefacts due to fast changing sound environments. Thus as one example this type of processing will typically be advantageous when processing consonants.

Following Bayesian learning, we will consider observations, which may be denoted D, and filter coefficients $w_n$ stochastic variables, whereby the normalized posterior follows from Bayes rule as:

$$p(w \mid \mathcal{D}) = \frac{p(\mathcal{D} \mid w)p(w)}{p(\mathcal{D})}$$

or as:

$$p(w \mid w_{old}, d) = \frac{p(w_{old}, d \mid w)p(w)}{p(w_{old}, d)}$$

wherein the time index n is omitted for reasons of clarity and wherefrom it follows that the aim of the present invention is to infer new adaptive filter coefficients w based on earlier filter coefficients $w_{old}$.

Using the terminology of Bayesian learning the expression $p(w_{old}, d|w)$ may be denoted the likelihood, the term p(w) may be denoted the prior and the term $p(w_{old}, d)$ may be denoted the marginal likelihood or the evidence.

By assuming that our old filter $w_{old}$ and our current observations d are independent given the new filter coefficients, w, then the likelihood may be factorized as:

$$p(w_{old}, d|w) = p(w_{old}|w)p(d|w)$$

Hereby, the normalized posterior may be given as:

$$p(w \mid w_{old}, d) = \frac{p(w_{old} \mid w)p(d \mid w)p(w)}{p(w_{old}, d)}$$

According to the present embodiment multivariate Gaussian distributions will be assumed for the likelihood and the prior whereby the following expressions may be derived for the likelihood:

$$p(w_{old}, d|w) = p(d|w)p(w_{old}|w) = \mathcal{N}_d(Xw, \sigma^2 I)\,\mathcal{N}_{w_{old}}(w, K)$$

wherein $\sigma^2$ represents the variance of the noise ε associated with the desired signal and wherein K is a transition covariance matrix that defines the dynamics of the adaptive filter 103, by defining how the filter coefficients may change from sample to sample (i.e. from one time index n−1 to the next time index n). By imposing dependencies between different filter coefficients via dense transition matrices, we limit the space of valid filters to those that makes sense given a previous filter state. It is noted that in the following the terms "filter" and "filter coefficients" may in some cases be used interchangeably when referring to the status of the filter (i.e. the values of the filter coefficients and for the prior:

$$p(w) = \mathcal{N}_w(\mu, \Sigma)$$

wherein μ represents the a priori mean of prior adaptive filter vectors (and in the following μ may simply be denoted the prior mean) and wherein Σ is a prior covariance matrix that is used to limit the set of possible filter states to those that are in fact desirable. The inventors have found that in case the observations of the desired signal are solely noise, or are a result of a sudden abrupt change in the acoustics then the filter estimators may suggest filter states that are not desirable and this can be at least partly avoided by configuring the prior covariance matrix Σ accordingly.

Similar to the variations concerning the assumption of the noise ε, it may also be assumed that the distributions of the likelihood and the prior, in variations may be e.g. various super Gaussian distributions like the student's t-distribution and the Laplace distribution, or such as various bounded distributions like e.g. a truncated Gaussian distribution, beta distribution or Gamma distribution.

However, a significant advantage of using Gaussian distributions is that they generally lead to closed-form expressions that are well suited for numerical calculation.

In the present context the term "closed-form expression" is to be understood as an expression that may include the basic arithmetic operations (addition, subtraction, multiplication, and division), exponentiation to a real exponent (which includes extraction of the $n^{th}$ root), logarithms, and trigonometric functions while on the other hand infinite series, continued fractions, limits, approximations and integrals cannot be part of a closed form expression.

As will be well known for a person skilled in the art a covariance matrix may be determined by calculating each element $\mathrm{cov}(Y_i, Y_j)$ in the matrix as:

$$\mathrm{cov}(Y_i, Y_j) = E[(Y_i - \mu_i)(Y_j - \mu_j)]$$

wherein the vector Y is the vector that holds the input to the covariance matrix and wherein $\mu_i = E(Y_i)$ is the expected value of the i'th entry in the vector Y.

Consider now the more general case of a Maximum-A-Posterior (MAP) scheme based on multiple signal samples of the desired signal represented by the vector d.

First we find the logarithm of the un-normalized posterior:

$$\log \hat{p}(w|w_{old}, d) \propto \log p(w_{old}|w) + \log p(d|w) + \log p(w)$$

Using the distributions derived above the un-normalized log-posterior becomes:

$$\begin{aligned}\log \hat{p}(w \mid w_{old}, d) \propto\ & \log \mathcal{N}_d(Xw, \sigma^2 I) + \log \mathcal{N}_{w_{old}}(w, K) + \log \mathcal{N}_w(\mu, \Sigma) = \\ & -\frac{1}{2\sigma^2}(d - Xw)^T(d - Xw) - \frac{1}{2}(w_{old} - w)^T K^{-1}(w_{old} - w) - \\ & \frac{1}{2}(w - \mu)^T \Sigma^{-1}(w - \mu)\end{aligned}$$

Now a closed form expression for the MAP solution to the setting of the adaptive filter coefficients can be found by taking the gradient of the un-normalized log-posterior, setting it equal to zero and solving for the adaptive filter coefficient vector w:

$$\frac{\partial}{\partial w}\log\hat{p}(w \mid w_{old}, d) = \frac{1}{\sigma^2}X^T(d - Xw) + K^{-1}(w_{old} - w) - \Sigma^{-1}(w - \mu) =$$

$$\frac{1}{\sigma^2}X^T d - \frac{1}{\sigma^2}X^T Xw + K^{-1}w_{old} - K^{-1}w - \Sigma^{-1}w + \Sigma^{-1}\mu =$$

$$\frac{1}{\sigma^2}X^T d + K^{-1}w_{old} + \Sigma^{-1}\mu - \left(\frac{1}{\sigma^2}X^T X + K^{-1} + \Sigma^{-1}\right)w =$$

$$0 \Leftrightarrow \left(\frac{1}{\sigma^2}X^T X + K^{-1} + \Sigma^{-1}\right)w = \frac{1}{\sigma^2}X^T d + K^{-1}w_{old} - \Sigma^{-1}\mu \Leftrightarrow w =$$

$$\left(\frac{1}{\sigma^2}X^T X + K^{-1} + \Sigma^{-1}\right)^{-1}\left(\frac{1}{\sigma^2}X^T d + K^{-1}w_{old} + \Sigma^{-1}\mu\right) =$$

$$(X^T X + \sigma^2(K^{-1} + \Sigma^{-1}))^{-1}(X^T d + \sigma^2 K^{-1}w_{old} + \sigma^2\Sigma^{-1}\mu) =$$

$$Bw_{old} + (I - B)\mu +$$

$$AX^T(I + XAX^T)^{-1}(d - X(Bw_{old} + (I - B)\mu))$$

where $$A = \frac{1}{\sigma^2}(K^{-1} + \Sigma^{-1})^{-1},$$

$$B = (K^{-1} + \Sigma^{-1})^{-1}K^{-1} =$$

$$(K - K(K + \Sigma)^{-1}K)K^{-1} = I - K(K + \Sigma)^{-1} = \Sigma(K + \Sigma)^{-1}$$

This closed form expression is generally applicable and therefore relevant for many variations of the present invention and not just for the embodiment of FIG. 1. It is a specific advantage of the closed form expression that an optimum setting of the adaptive filter coefficients, according to the Maximum A Posterior (MAP) criteria can be achieved for each sampling of the input signal to the adaptive filter and of the desired signal. This is opposed to more traditional methods of updating adaptive filters that are based on taking steps in the right direction, which has as a consequence that the adaptive filter will pass through intermediate filter coefficient states that are not optimal.

It is another advantage of the present invention that it allows the operation of the adaptive filter to be configured based on a different perspective. From a traditional adaptive filter viewpoint the filter update equation is analyzed in order to understand the operation of the adaptive filter. According to the present invention, the operation of the adaptive filter may be analyzed by considering the three terms from the un-normalized log-posterior.

The first term $\mathcal{N}_d(Xw, \sigma^2 I)$ is purely data dependent, thus if only this term were used, we would have a Maximum Likelihood optimization. The value of the noise variance, $\sigma^2$, may be a pre-determined constant or it may be a variable that is based on some form of real-time noise estimation. Within the present context the noise variance may also be denoted a hyper parameter, because it is a parameter residing in a probability density function, e.g. in the likelihood or the prior distribution as opposed to parameters of the model of the underlying data, i.e. as opposed to the adaptive filter coefficients fitting the data.

Generally it is desirable to keep the value of the noise variance relatively big since a too big value only provides insignificant impact on the overall adaptive filter operation, while, on the other hand, a too small value will bias the operation of the adaptive filter towards the undesirable situation where the adaptive filter seeks to adapt to the noise.

The second term $\mathcal{N}_{w_{old}}(w,K)=\mathcal{N}_w(w_{old},K)$, defines how the old filter regularizes the new one, i.e. how additional information is introduced in order to prevent e.g. over-fitting. Typically this information is in the form of a penalty for complexity, such as restrictions for smoothness or bounds on a vector space norm.

Thus if the transition covariance matrix, K, is diagonal then the values in the diagonal carry a somewhat similar interpretation as an individual step size on each of the adaptive filter coefficients in w.

However, by implementing dense versions of K (non-zero off-diagonal elements) significant improvements may be obtained, because the off-diagonal elements allow the behavior of certain filter coefficients to be controlled based on the current state of other filter coefficients. This is an important aspect that it is difficult to incorporate in traditional methods for operating adaptive filters.

The third and last term $\mathcal{N}_w(\mu, \Sigma)$, the prior, is used to favor particular types of filter coefficient settings. One simple way of using this is to define the prior to have zero mean (i.e. $\mu=0$) and specify that the prior covariance matrix, $\Sigma$, is a diagonal matrix, whereby the elements in the diagonal will direct (or leak) the values of the filter coefficients towards zero. Additionally, by incorporating off-diagonal roll-off for the matrix elements, then smoothness between the adaptive filter coefficients, and hereby also of the impulse response of the adaptive filter, will be favored.

According to one specific variation of the various embodiments according to the invention the prior covariance matrix $\Sigma$ may be configured such that the off-diagonal elements along a specific row alternates between being positive and negative, whereby sounds comprising some degree of periodicity such as e.g. music or voiced speech are favored by the adaptive filter and therefore will tend to pass through the adaptive filter un-attenuated. This type of variation may especially be advantageous in case where the hearing aid system is adapted to select between a multitude of available prior covariance matrices based on e.g. a classification of the sound environment or in response to a user interaction.

In further variations according to the embodiment of FIG. 1, the closed form expression for updating adaptive filter coefficients may be derived based on the normalized posterior instead of the un-normalized. However, since the denominator of normalized posterior does not depend on the adaptive filter coefficients, it is not necessary to base the derivation on the normalized posterior.

Considering again the specific embodiment of FIG. 1 the first filter estimator 104 is set up to provide the current filter vector w, the second filter estimator 105 is set up to provide a filter vector $w_{slow}$ based on a slow MAP estimation and the third filter estimator 106 is set up to provide a filter vector $w_{fast}$ based on a fast MAP estimation.

According to the embodiment of FIG. 1 $w_{slow}$ and $w_{fast}$ are determined using the closed form formula for w that is given above, by selecting constant values for $\sigma$, K, $\mu$ and $\Sigma$.

$\sigma_{slow}$, and $\sigma_{fast}$ are normally identical and are, according to the present embodiment, determined as the standard deviation of the first or the second digital input signal when these signals primarily consists of noise. According to a specific embodiment the value of $\sigma_{slow}$, and $\sigma_{fast}$ is constant and set to 0.02. In variations the constant value may be selected from the interval between 0.01 and 0.5 and in further variations the value may be continuously updated adapted based on a determined noise estimate. In yet further variations $\sigma_{slow}$, may be set to be relatively lager than $\sigma_{fast}$ whereby the speed of the second filter estimator 105 is decreased relative to the speed of the third filter estimator 106.

The transition covariance matrices $K_{slow}$, and $K_{fast}$ are both diagonal matrices, wherein the values of the diagonal elements of the slow covariance transition matrix $K_{slow}$ are smaller than the corresponding values of the fast covariance transition matrix $K_{fast}$. Hereby the MAP estimation of the filter coefficients $w_{slow}$ from the second filter estimator 105 is only allowed to change slowly relative to the MAP estimation $w_{fast}$ from the third filter estimator 106. According to a specific embodiment the center element of the diagonal elements in $K_{slow}$ is set to $5\times10^{-4}$ and the values of the remaining diagonal elements are determined by assuming a symmetrical exponential function, such as a normal distribution, around the center element and configured such that the outermost elements values have a value of around $3\times10^{-4}$, and the corresponding value of the center element of the diagonal elements in $K_{fast}$ is set to $0.1\times10^{-4}$ and the value of the outermost elements is around $0.05\times10^{-4}$ and the remaining diagonal elements are determined by assuming the same type of exponential function as used in $K_{slow}$.

The prior covariance matrices $\Sigma_{slow}$ and $\Sigma_{fast}$ are both diagonal uniform matrices, wherein the value of the diagonal elements of the slow prior covariance matrix $\Sigma_{slow}$ is larger than the corresponding value of the diagonal elements of the fast prior covariance matrix $\Sigma_{fast}$. Preferably the uniform value of the diagonal elements of $\Sigma_{fast}$ is set to a value close to zero such that the MAP estimation $w_{fast}$ from the third filter estimator 106 will tend to suggest something not too far from the null vector.

According to the present embodiment the value of the diagonal elements of the fast prior covariance matrix $\Sigma_{fast}$ is set to one and in variations in the range between 0.5 and 10, whereas the value of the diagonal elements of the slow prior covariance matrix $\Sigma_{slow}$ is set to 1000 and in variations in the range between 500 and 50 000 and in further variations even higher values may be selected.

According to the present embodiment the prior mean vectors $\mu_{fast}$ and $\mu_{slow}$ are both set to be null vectors. In variations the elements of the prior mean vectors are set to be less than one.

The N×N transition covariance matrix K, used to determine the current filter coefficient vector w can now be determined as:

$$K=[W-E(W)][W-E(W)]^T, \text{ where } W=[w_{slow}, w_{fast}, w_{old}]$$

wherein the third filter coefficient vector $w_{old}$, is determined as the most recent (i.e. the previous sample) setting of the adaptive filter.

In variations of the present embodiment, $w_{old}$ needs not be determined as exactly the most recent setting, i.e. $w_{n-1}$ it may also be some other previous sample e.g. the second most recent sample $w_{n-2}$.

The prior covariance matrix $\Sigma$, used to find the current filter coefficient vector w is determined based on the variance over the most recent say 3000 fast filters.

The mean of these most recent say 3000 fast filters is used to determine the value of $\mu$ and in variations the number of fast filters used to determine the mean may be selected from the range between 500 and 5000 or even from a range between 50 and 50 000. The standard deviation $\sigma$ is given a fixed value that according to the present embodiment is the same as the values for $\sigma_{slow}$ and $\sigma_{fast}$.

However, in variations of the present embodiment the value of the standard deviation $\sigma$ may be a variable that is determined dynamically. A multitude of methods for estimating dynamically the standard deviation of a signal are available as will be obvious for a person skilled in the art.

However, the inventive derivation of the closed form expression for the MAP adaptive filter coefficient vector w does not require three different adaptive filter estimators, as in the embodiment of FIG. 1, to be implemented. It is neither a requirement, for the embodiment of FIG. 1, that the second and third adaptive filter estimators 105 and 106 apply the MAP methodology, in fact basically any adaptive filter estimation technique can be used to provide the adaptive filter coefficient vectors $w_{slow}$ and $w_{fast}$.

However, in case it is selected to apply the MAP methodology in at least one of the second and third adaptive filter estimators 105 and 106 then it is noted that use of the MAP methodology does not require use of the derived closed form expression in order to find the MAP solution. Instead more traditional implementations, that are known in the prior art, may be used, in order to find the MAP solution such as gradient based methods wherein an iterative algorithm is used to take steps towards the MAP solution. Thus these approaches may be advantageous e.g. in cases where it is possible to find a closed form expression for the posterior.

In a specific variation of the embodiment of FIG. 1 the second and third adaptive filter estimators are omitted and the adaptive filter coefficient vector w is determined based on fixed covariance matrices. According to such a variation the fixed covariance matrices K and $\Sigma$ to be used in the single adaptive filter estimator may be equal to either the fast or the slow coefficient estimators, $K_{slow}$, $K_{fast}$, $\Sigma_{slow}$ and $\Sigma_{fast}$, or a combination, such as an average, of the fast and slow covariance matrices.

In yet further variations a current covariance matrix may be selected from a multitude of covariance matrices based on a classification of the current sound environment. The same variations can be used to determine the standard deviation $\sigma$ and the mean prior filter coefficient vector $\mu$.

Generally the methods used to find the value of the hyper parameters K, $\Sigma$, $\mu$ and $\sigma$ may be selected independently of each other, as one example the covariance matrices may be dependent of a classification of the sound environment while this need not be the case for $\mu$ and $\sigma$.

Furthermore in variations of the embodiment of FIG. 1, only the second or the third adaptive filter estimators is omitted, whereby processing requirements may be relieved at the cost of performance.

The embodiment of FIG. 1 is based on the assumption that the noise and the probability density functions of the likelihood and the prior are assumed to be Gaussian. However, other distributions may also be suitable such as various super Gaussian distributions like the student's t-distribution and the Laplace distribution, or such as various bounded distributions like e.g. a truncated Gaussian distribution, beta distribution or Gamma distribution.

The embodiment of FIG. 1 is also based on the assumption that a multitude of samples of the desired signal are available and given in the vector $d_n$. However, in variations closed-form expressions for the case of having only the current value of the desired signal $d_n$ may be derived directly from the corresponding expressions for the case of having a multitude of samples of the desired signal:

$$w = Bw_{old} + (I - B)\mu + Ax_n(1 + x_n^T A x_n)^{-1}(d - x_n^T(Bw_{old} + (I - B)\mu))$$

where $$A = \frac{1}{\sigma^2}(K^{-1} + \Sigma^{-1})^{-1},$$

$$B = \Sigma(K + \Sigma)^{-1}$$

Furthermore it is noted that the configuration of FIG. 1 is only one example of an application, wherein the inventive method for operating an adaptive filter can be used. It should be appreciated that the present invention may be used independently of the chosen application at least in so far that the application includes an adaptive filter that operates in accordance with the formula: $d_n = w_n^T x_n$, wherein the signal sample $d_n$ represents a desired signal, wherein $w_n$, represents the adaptive filter coefficients at time n, wherein $x_n$ represents recent sample values of the input signal to the adaptive filter and wherein ε is a random variable that represents noise.

However, in variations of the various embodiments of the invention, the adaptive filter may be operated in such a way that non-linear phenomenon can be modelled, e.g. by allowing the vector $x_n$ to comprise non-linear terms, i.e. exponentials of the recent sample values of the input signal to the adaptive filter.

Figure 2:
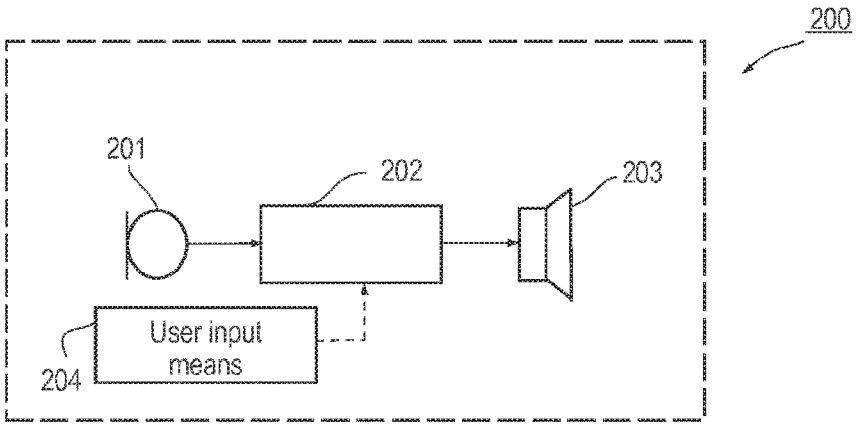
FIG. 2 illustrates highly schematically details of a selected part of a hearing aid system according to an embodiment of the invention.

Reference is therefore made to FIG. 2, which illustrates highly schematically a selected part, namely a hearing aid, of a hearing aid system 200 in its most generic form. The hearing aid comprises an acoustical-electrical input transducer 201 (typically a microphone), a digital signal processor 202 adapted to relieve a hearing deficit, an electrical-acoustical output transducer 203 (typically denoted a receiver) and user input means 204 that allows a hearing system user to interact with the hearing aid system 200.

Figure 3:
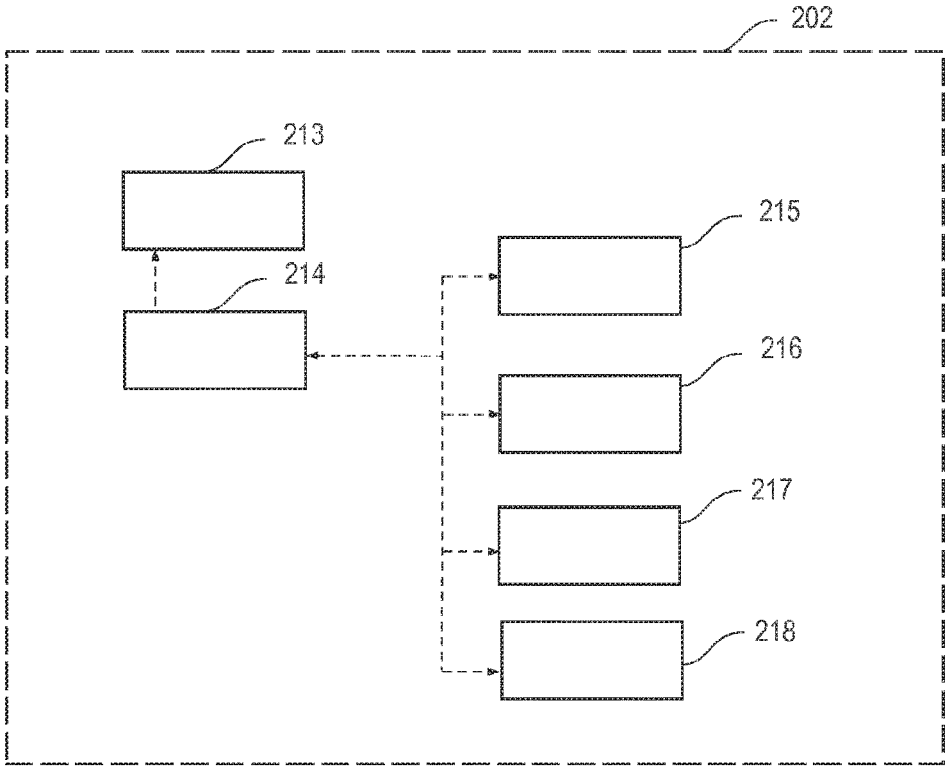
FIG. 3 illustrates highly schematically a selected part of a hearing aid according to an embodiment of the invention.

Reference is then made to FIG. 3, which illustrates highly schematically a selected part of the digital signal processor 202 of FIG. 2 according to an embodiment of the invention. The digital signal processor 202 comprises an adaptive filter 213, an adaptive filter estimator 214, a first memory 215 holding a transition covariance matrix, a second memory 216 holding a prior covariance matrix, a third memory 217 holding an estimate of the noise variance of a desired signal and a fourth memory 218 holding a mean of previous adaptive filter coefficients.

The embodiment of FIG. 3 therefore illustrates the generic nature of the invention, according to the embodiment of the invention wherein a closed form expression, comprising a transition covariance matrix, a prior covariance matrix, an estimate of the noise and a mean of adaptive filter coefficient settings, is used to control the operation of an adaptive filter. Thus it is emphasized that the present invention is generally independent of the hearing aid system context that the adaptive filter is part of. However, the operation of an adaptive filter according to embodiments of the invention may in particular be advantageous in the context of e.g. speech enhancement, acoustical feedback suppression, de-reverberation, spectral transposing and noise estimation.

In further variations of the various embodiments of the invention, at least parts of the processing required for operating the adaptive filter may be carried out in an external device. In more specific variations the hearing aid system is configured such that samples of the digital input signal and at least one sample of the digital desired signal are transferred from a hearing aid and to the external computing device, and wherein optimum adaptive filter coefficients are transferred back to the hearing aid. Typically the transfer of data will be carried out using a wireless link.

In other variations of the various embodiments of the invention, the hearing aid system comprises a plurality of memories holding transition covariance matrices and prior covariance matrices and comprises an algorithm that determines the values of the adaptive filter coefficients and is adapted such that a specific transition covariance matrix and/or prior covariance matrix is selected among the given plurality of covariance matrices as a function of a classification of a current sound environment or in response to a user interaction, wherein the user selects at least one specific covariance matrix. In more specific variations the plurality of memories holding a plurality of transition and prior covariance matrices are accommodated in an external computing device, wherefrom the selected covariance matrices may be uploaded to the hearing aids in response to either a classification of a current sound environment or a user interaction. In yet other variations the covariance matrices may be downloaded from an external server using the external computing device as a gateway. In still further variations of the various embodiments the plurality of memories holding the covariance matrices may be integrated in a single memory.

In yet further variations of the various embodiments of the invention, the hearing aid system is adapted to continuously update the covariance matrices and in further variations also the noise estimation based on optimization of these hyper-parameters as will be further discussed below.

The present invention is particularly advantageous in so far that it allows an adaptive filter to be updated by jumping directly from one estimated MAP optimum of adaptive filter coefficients to a next estimated MAP optimum without having to move along a gradient towards an estimated optimum and hereby without having to take intermediate steps based on a predefined step size, which inevitably will require the adaptive filter to accept settings that are not an estimated optimum.

The inventors have demonstrated that the method and corresponding systems of the present invention allow the adaptive filter to react very fast to rapid changes in the input signal and the desired output signal whereby the amount of artefacts can be considerably reduced.

In yet another variation of the disclosed embodiments the adaptive filter 103 may be replaced by at least one sub-band adaptive filter positioned in one of a multitude of frequency bands provided by an analysis filter bank.

Figure 4:
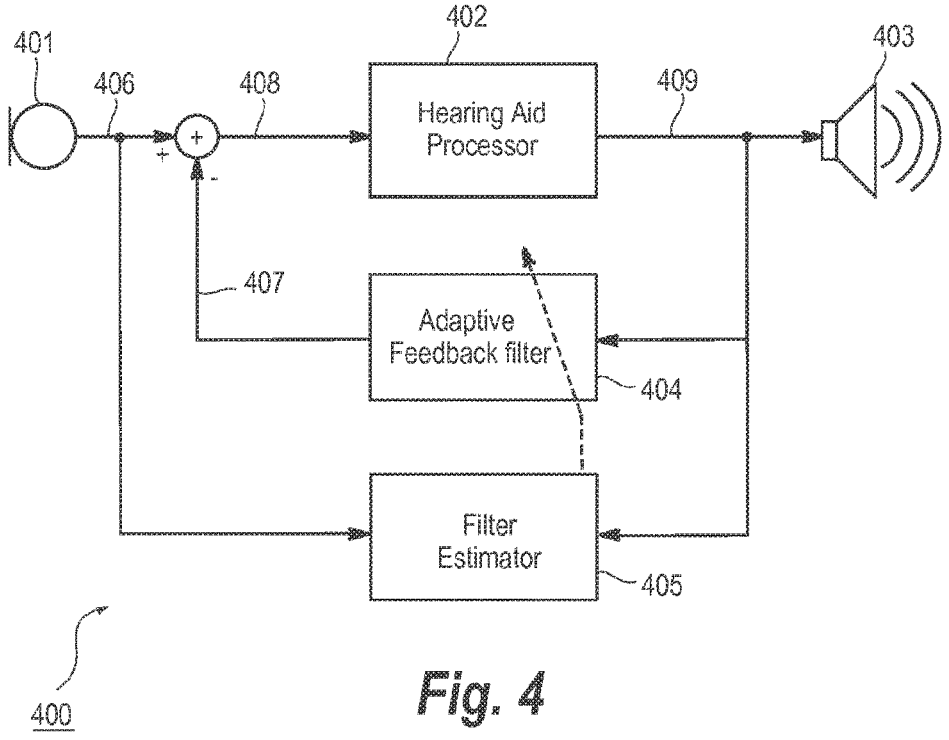
FIG. 4 illustrates highly schematically a hearing aid according to an embodiment of the invention.

Reference is now given to FIG. 4 which illustrates highly schematically a hearing aid with an adaptive feedback suppression system comprising an adaptive feedback suppression filter. The hearing aid 400 basically comprises a microphone 401, a hearing aid processor 402, a receiver 403, an adaptive feedback suppression filter 404 and a filter estimator 405 adapted for determining the setting of the adaptive filter coefficients of the adaptive feedback suppression filter 404. In FIG. 4, a feedback suppression signal 407, provided as output signal from the adaptive feedback suppression filter 404, is subtracted from an input signal 406 in a summing unit and the summing unit output signal 408 is used as input signal for the hearing aid processor 402 that is adapted for relieving the hearing deficit of an individual user. The hearing aid processor output signal 409 is provided to the receiver 403, the adaptive feedback suppression filter 404 and the filter estimator 405. Finally the input signal 406 is also provided to the filter estimator 405.

Thus in the context of the present application the input signal 406 is to be considered the desired signal and the hearing aid processor output signal 409 is to be considered the input signal (to the adaptive filter).

The method of operating an adaptive filter according to the present invention is particularly advantageous when implemented in the context of adaptive feedback suppression because the number of adaptive filter coefficient vector settings, that may be considered acceptable (i.e. the sample space), is relatively limited because the physical parameters, that determines the underlying model, are relatively constant and consequently the prior covariance matrix may be determined such that a significant number of non-acceptable adaptive filter coefficient vector settings can be avoided.

This may especially be advantageous in order to suppress sound artefacts arising as a consequence of direct closed loop bias, i.e. the fact that correlated sound (such as music) from the sound environment may trigger the feedback system to try to cancel the sounds from the sound environment, which obviously is not a desirable situation. In variations the disclosed embodiments may also be applied for suppression of feedback based on indirect closed loop or joint input-output methods.

The prior covariance matrix may be a constant, which is determined based on a so called feedback test that is carried out as part of the normal hearing aid fitting, wherein the feedback test comprises an input signal that is totally random and therefore can be used to estimate the transfer function of the acoustical feedback path and hereby the corresponding values of the diagonal elements of the prior covariance matrix.

However the prior covariance matrix may additionally or alternatively be updated with regular intervals or on request by the user, based on natural sounds in the environment. According to a specific variation the hearing aid system has means for determining whether a reliable estimate of the acoustical feedback transfer function can be obtained. Basically this includes determining whether the feedback path is relatively stationary and whether the sound environment may induce bias, i.e. whether the feedback path is well estimated.

According to a specific variation of the embodiment of FIG. 4 the transition covariance matrix may be set up to avoid intermediate filter states that may be undesirable. One example of such an undesirable intermediate filter state may be experienced when the adaptive filter setting is changed from a howl inducing setting and to a non-howl inducing setting by passing through an intermediate state where the filter provides a close to clean sine signal in order to suppress the howling. By carefully designing the covariance transition matrix this intermediate state may be avoided.

On a general level the underlying model of the feedback system can be determined by considering the acoustical feedback path that primarily is determined by the vent of the hearing aid earpiece, the residual volume, the transfer functions of the microphone and receiver and the transfer function of the sound propagation in free space (i.e. outside the earpiece and ear canal) from the vent and to the hearing aid microphone. Among these physical parameters primarily the transfer function of the sound propagation in free space is expected to be the primary source of sudden changes in the feedback path, such as in case someone holds his hand, or a telephone, close to the hearing aid microphone. However sound leakage around the earpiece when positioned in the ear canal of the user may also lead to sudden changes, e.g. as a consequence of the hearing aid user chewing or yawning.

The underlying model of the feedback path may contain non-linear parts due to the inherent non-linearity of the microphone and receiver transfer function. The implementation of the present invention in the context of adaptive feedback suppression therefore presents a case where the variation of the present invention, that comprises a non-linear adaptive filter, may be advantageous. As one example the adaptive filter may be non-linear in the sense that the filter prediction comprises terms where an input signal sample is squared.

According to another aspect of the present invention, the disclosed embodiments and their various variations may be further improved by considering optimization of the hyper parameters used to define the assumed probability distributions of the prior, likelihood and noise associated with the methods of adaptive filtering disclosed in the present invention.

Considering now again FIG. 1, an estimate of the noise level in the signals received by the microphones 101 and 102 may be determined by maximizing the marginal likelihood, i.e. the denominator of the normalized posterior. The marginal likelihood that may also be denoted the evidence is given by:

$$p(d_n, w_{old}) = \int_w p(d_n, w_{old} | w_n) p(w_n) dw_n = \int_w p(d_n | w_n) p(w_{old} | w_n) p(w_n) dw_n$$

If assuming that the likelihood and prior distributions are Gaussian and that the noise variance $\sigma_d^2$ is also Gaussian then the integral required for determining the marginal likelihood can be solved analytically and a closed form expression derived for the marginal likelihood as a function of the hyper-parameters defined by the assumed distributions. Subsequently the marginal likelihood can therefore be maximized with respect to e.g. the assumed Gaussian noise variance $\sigma_d^2$.

Consider now the case, where only the current value of the desired signal $d_n$ is available. In this case we find that:

$$p(d_n, w_{old}) = \int_w \mathcal{N}_d(w_n^T x_n, \sigma_d^2) \mathcal{N}_{w_{old}}(w_{old}, K) \mathcal{N}_{w_n}(\mu, \Sigma) dw_n,$$

that may be expressed as:

$$p(d_n, w_{old}) = \mathcal{N}_d(x_n^T w_{old}, \sigma_d^2 + x_n^T K x_n) \mathcal{N}_\mu\left(w_{old} + K x_n \frac{d_n - x_n^T w_{old}}{\sigma_d^2 + x_n^T K x_n}, A + \Sigma\right)$$

wherein A is defined as:

$$A = K - \frac{1}{\sigma^2 + x_n^T K x_n} K x_n x_n^T K$$

Now the assumed Gaussian noise variance $\sigma_d^2$ can therefore be determined by maximizing the obtained closed form expression for the marginal likelihood with respect to the assumed Gaussian noise variance $\sigma_d^2$. The maximization may be carried using an iterative numerical optimization technique selected from a group comprising the Broyden-Fletcher-Goldfarb-Shanno (BFGS) algorithm, the Simplex algorithm and gradient descent or ascent algorithms. However, in preferred variations the maximization of the closed form expression may be carried out based on regularization of the closed form expression with a hyper-prior.

According to one specific embodiment the maximization is carried out by minimizing the negative logarithm of the closed form expression for the marginal likelihood using a gradient descent algorithm, which is relatively simple and therefore particularly suitable for implementation in a hearing aid system because the partial derivative with respect to the assumed Gaussian noise can be expressed as:

$$\frac{\partial(-\log p(d_n, w_{old}))}{\partial \sigma_d} = \frac{\sigma_d}{a} - \left(\frac{e}{a}\right)^2 \sigma_d + \frac{\sigma_a b}{a(a-b)} + \frac{\sigma_d\left(r - \frac{be}{a}\right)}{(a-b)^2}\left(2e - \frac{be}{a} - r\right),$$

-continued where:

$$a = \sigma_d^2 + x_n^T K x_n$$

$$b = x_n^T K (K + \Sigma)^{-1} K x_n$$

$$e = d_n - x_n^T w_{old}$$

$$r = x_n^T K (\Sigma + K)^{-1} (\mu - w_{old})$$

$$v = x_n^T K (\Sigma + K)^{-1} (\mu - w_{old}) - \frac{b(d_n - x_n^T w_{old})}{a} = r - \frac{be}{a}$$

The other hyper parameters μ, K and Σ may be set as disclosed with reference to the FIG. 1 embodiment and it variations. But basically the other hyper parameters may be determined in any other suitable manner.

According to a specific variation all the hyper parameters of the assumed distributions may be optimized together using a gradient based maximization of the marginal likelihood.

According to another variation of the FIG. 1 embodiment, the adaptive filter 103 need not be operated in the same manner as disclosed with reference to FIG. 1 or with reference to the associated variations of the FIG. 1 embodiment. In particular another posterior may be selected, e.g. one that does not depend on a previous setting of the adaptive filter coefficients.

In still other variations the assumed distributions of at least some of the likelihood, prior and noise distributions need not be assumed Gaussian. However, the Gaussian assumption generally provides hyper parameter optimization algorithms with relatively relaxed requirements to processing power.

In further variations standard algorithms such as LMS and RLS may be used for operating the adaptive filter independent on the above mentioned methods for estimating the noise standard deviation or noise variance.

In yet further variations, the output signals from the adaptive filter 103 or the summing unit 107 need not be provided to the remaining parts of the hearing aid system 100, instead the only purpose of the adaptive filter may be to provide the noise estimate, which then may be applied for a variety of purposes in the hearing aid system all of which will be well known for a person skilled in the art. However, the noise estimate will obviously be particularly useful as input to noise suppression algorithms.

According to yet another variation the disclosed methods for hyper parameter optimization may also be applied in other configurations than the one disclosed in FIG. 1. As one example the configuration of an adaptive line enhancer may be particularly advantageous for estimating noise.

Figure 5:
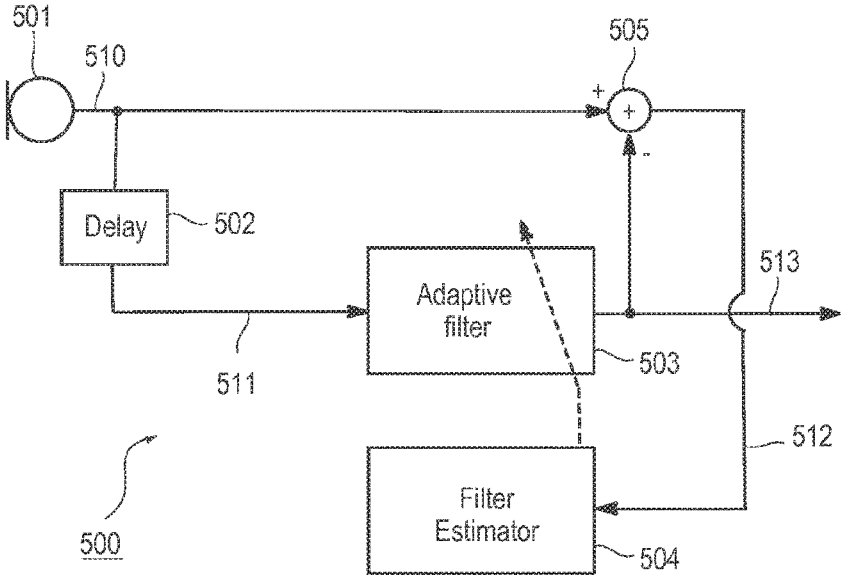
FIG. 5 illustrates highly schematically a selected part of a hearing aid according to an embodiment of the invention.

Reference is therefore now given to FIG. 5, which illustrates highly schematically a selected part of a hearing aid system 500 with an adaptive line enhancer. The selected part of the hearing aid system 500 comprises a microphone 501, a time delay unit 502, an adaptive filter 503, a filter estimator 504 adapted for determining the setting of the adaptive filter coefficients of the adaptive filter 503 and a summing unit 505. In FIG. 5, an input signal 510 from the microphone 501 is branched and provided to the time delay unit 502 and to a first input of the summing unit 505. The time delayed input signal 511 that is output from the time delay unit 502 is provided to the adaptive filter 503 and the output signal from the adaptive filter 513, which may also be denoted the line enhanced output signal, is branched and provided to the remaining parts of the hearing aid and to a second input of the summing unit 505, whereby the line enhanced output signal 513 is subtracted from the input signal 510 in the summing unit and the resulting summing unit output signal 512 is provided to the adaptive filter estimator 504 that is set up to determine the set of adaptive filter coefficients of the adaptive filter 503 that will minimize the summing unit output signal 512.

The adaptive line enhancer functions by delaying the input signal 510 such that the noise part of the input signal 510 becomes de-correlated from the time delayed input signal 511, whereby the line enhanced output signal 513 ideally becomes an estimate of the noise free part of the input signal 510.

Thus in the context of the present application the input signal 510 (from the microphone) is to be considered the desired signal and the time delayed input signal 511 is considered to be the input signal (to the adaptive filter).

According to the embodiment of FIG. 5 the line enhanced output signal 513 is provided to the remaining parts of the hearing aid system i.e. to a digital signal processor configured to provide an output signal for an acoustic output transducer, wherein the output signal from the digital signal processor is adapted to alleviate a hearing deficit of an individual hearing aid user. Thus according to the present embodiment the remaining parts of the hearing aid system comprise amplification means adapted to alleviate a hearing impairment. In variations the remaining parts may also comprise additional noise reduction means. For reasons of clarity these remaining parts of the hearing aid system are not shown in FIG. 5. However, in variations the line enhanced output signal 513 is only provided to the summing unit 505 and not to the remaining parts of the hearing aid system. Thus the purpose of the adaptive line enhancer according to this variation is only to estimate the noise of an input signal.

In yet other variations the methods disclosed with reference to FIG. 1 may also be applied for an adaptive line enhancer as disclosed with reference to FIG. 5. Thus an adaptive line enhancer according to the present invention needs not comprise hyper parameter optimization.

Generally the disclosed methods for hyper parameter optimization require significant amounts of processing resources and this may in particular be a problem if such methods are to be implemented in a hearing aid system or an individual hearing aid.

According to another variation of the disclosed embodiments parts of the hyper parameter optimization may therefore be carried out off-line in order to relieve the requirements to processing resources in the hearing aid system.

In the present context the term "off-line" may be construed to mean that the "off-line" method steps are carried out as part of the hearing aid system fitting before handing over the hearing aid system to the user.

Thus according to an embodiment of the present invention a method of fitting a hearing aid system comprising the following steps of may be carried out.

First a posterior is selected. The posterior may be the same as disclosed with reference to the FIG. 1 embodiment, i.e. $p(w|w_{old}, d)$. However, the present embodiment may also be based on other posteriors, such as posteriors that don't depend on previous adaptive filter coefficient settings (i.e. $w_{old}$).

In a second step distributions for the prior and the likelihood are selected. According to the present embodiment the prior and likelihood distributions are assumed to be Gaussian but this needs not be the case.

In a third step an expression for the marginal likelihood (which may also be denoted the evidence) is derived based on the selected distributions for the prior and the likelihood.

In a fourth step the marginal likelihood is optimized with respect to a first selected hyper parameter, using an iterative optimization method based on a specific input signal sample and based on a selected set of initial values for each of the hyper parameters of the selected probability distributions, hereby providing a first optimized value of the first selected hyper parameter. Thus, according to the present embodiment, only one of the hyper parameters is optimized. However, in variations a multitude or all of the hyper parameters are optimized. Generally optimization of a multitude of the hyper parameters will require the use of gradient based optimization methods.

In a fifth step the fourth step is repeated using a different set of initial values for each of the hyper parameters while still using the same specific input signal sample, and hereby a multitude of first optimized values for the first selected hyper parameter is provided. This step will be required for most situations and for most assumed probability distributions in order to avoid that the optimization finds a local optimum instead of a global optimum.

In a sixth step a second optimized value of the first selected hyper parameter is provided based on a determination of the highest value of the marginal likelihood, among the values of the marginal likelihood that are calculated using the first optimized value for the first selected hyper parameter and using the corresponding different sets of initial values for each of the not-optimized hyper parameters that formed the basis for the optimization of the first selected hyper parameter and by using the same input signal sample. Thus the second optimized value of the first selected hyper parameter provides an improved estimate of a global optimum.

In a seventh step the fourth, fifth and sixth steps are repeated for a multitude of input signal samples, whereby a multitude of second optimized values of the first selected hyper parameter is provided. This is advantageous since this multitude of second optimized values of the first selected hyper parameter represents an a-priori hyper parameter optimization that depends on the input signal samples, which again represents the sound environment.

In an eight step third optimized values of the first selected hyper parameter is selected from said multitude of second optimized values by grouping the multitude of second optimized values in clusters and subsequently selecting a third optimized value for each cluster based on an average of the multitude of the second optimized values in the cluster. According to the present embodiment each cluster is associated with a sound environment that the hearing aid system is able to identify using one of the many sound classification techniques that are well known within the art of hearing aid systems.

However, in variations the third optimized value needs not be determined based on an average but may be determined in some other way such as by simply selecting the value that together with the corresponding input signal sample provides the highest value of the marginal likelihood. According to another variation the third optimized value needs not be selected for each cluster, instead one global value may be selected.

In a ninth and final step said third optimized value of first selected hyper parameter is stored in a hearing aid system.

According to yet another variation of the disclosed embodiments the hyper parameter optimization may be used to determine the optimum number of filter coefficients in the adaptive filter. This requires that the disclosed methods for determining optimized hyper parameters are carried out independently for a multitude of different adaptive filter lengths (i.e. the number of adaptive filter coefficients), and the marginal likelihood is then calculated for each adaptive filter length and its corresponding optimized hyper parameters, and the filter length that provides the largest value of the marginal likelihood is selected. In variations this may be carried out for a multitude of different sound environments.

According to a specifically advantageous variation the optimum filter length is determined for a multitude of different sound environments such that when the hearing aid system identifies a specific sound environment then this triggers a corresponding selection of specific hyper parameters where at least one of the hyper parameters has been optimized and according to yet a further variation the appropriate adaptive filter length for each of the identified sound environments is selected by careful design of the prior covariance matrix.

However, in case Gaussian behavior is not assumed then a prior covariance matrix may not be available and in that case the adaptive filter length may be selected using some other mechanism, such as simply setting one or more adaptive filter coefficients to zero for certain identified sound environments.

Thus according to the present embodiment a set of hyper parameter values, representing a set of clusters, for at least one hyper parameter is stored in the hearing aid system, together with information on the selected posterior and the assumed probability distributions. Hereby the hyper parameter optimization in the hearing aid system can be carried out in a variety of different manners.

One method comprises the following steps to be carried out on-line in the hearing aid system for each sample:

- calculating the marginal likelihood for each cluster i.e. by using the selected set of initial (i.e. not optimized) hyper parameter values combined with the value, for the at least one hyper parameter, that is selected to represent the cluster, and
- using the hyper parameter set of the cluster that provides the highest value of the marginal likelihood when calculated for the present sample.

This hyper parameter optimization method is advantageous in that it only requires limited processing resources.

According to a variation, another method comprises the following steps to be carried out on-line in the hearing aid system for each sample:

- using the hyper parameter set of the cluster that provides the highest value of the marginal likelihood when calculated for the present sample, as a set of initial values and use an iterative optimization method based on the present sample to provide an optimized value of at least one hyper parameter.

This hyper parameter optimization method is advantageous in that it only requires relatively limited processing resources, while providing improved performance. The trade-off between processing resources and performance may be tailored by selecting the number of iterative steps that the optimization method is allowed to carry out.

In a variation the most recent set of hyper parameter values may be used, instead of the cluster hyper parameter sets, if the calculated value of the marginal likelihood is higher for the present sample.

In yet another variation all the steps required for hyper parameter optimization may be carried out by the hearing aid system, however, at least at present, this will present significant disadvantages with respect to processing power and consequently also with respect to hearing aid system size and power consumption.

In further variations the methods and selected parts of the hearing aids according to the disclosed embodiments may also be implemented in systems and devices that are not hearing aid systems (i.e. they do not comprise means for compensating a hearing loss), but nevertheless comprise both acoustical-electrical input transducers and electro-acoustical output transducers. Such systems and devices are at present often referred to as hear-ables. However, at least partly wearable health monitoring devices (often referred to as wear-ables) and headsets are yet other examples of such systems.

The invention may be especially advantageous within the art of hearing aid systems and more generally within the art of at least partly wearable health monitoring devices that may also be denoted wearables.

Other modifications and variations of the structures and procedures will be evident to those skilled in the art.

The invention claimed is:

1. A method of operating a hearing aid system having an adaptive filter with N adaptive filter coefficients, said method comprising the steps of:

providing a first set of input signal samples;

providing at least one second signal sample representing a desired signal;

filtering the first set of signal samples in the adaptive filter, in accordance with the formula: $d_n = X_n w_n^T + \varepsilon$, wherein $d_n$ is a vector or a scalar comprising the at least one second signal sample representing the desired signal, wherein $w_n$ is a vector holding the adaptive filter coefficients, wherein $X_n$ is a matrix or a vector comprising the first set of input signal samples, wherein ε represents noise and wherein n is a time index, selecting a posterior distribution given by $p(w_n | w_{n-1}, d_n)$;

using a closed form expression, determining an optimum setting of the adaptive filter coefficients as the setting that maximizes the posterior distribution; and selecting an optimum setting of the adaptive filter coefficients when updating the adaptive filter.

2. The method according to claim 1 wherein the posterior distribution or an approximation of the posterior is a multivariate Gaussian distribution.

3. The method according to claim 1, wherein the step of determining the optimum setting of the adaptive filter coefficients comprises the further steps of:

deriving an expression for the gradient of the posterior distribution, or for the gradient of an expression derived from the posterior distribution, with respect to the adaptive filter coefficients; and setting the expression for the gradient equal to zero and solving with respect to the adaptive filter coefficients and hereby deriving a closed form expression for the adaptive filter coefficients that maximizes the posterior distribution.

4. The method according to claim 3, wherein the expression derived from the posterior distribution is the logarithm of the posterior distribution.

5. The method according to claim 1, wherein the step of determining the optimum setting of the adaptive filter coefficients comprises the further step of:

using the closed form expression given below to determine adaptive filter coefficients that maximizes the posterior distribution:

$$w_n = Bw_{n-1} + (I - B)\mu + \frac{Ax_n}{1 + x_n^T A x_n}(d_n - x_n^T (I - B)\mu - x_n^T B w_{n-1})$$

wherein, $$A = \frac{1}{\sigma_2}(\Sigma^{-1} + K^{-1})^{-1},\ B = \Sigma(K + \Sigma)^{-1}$$

wherein $\sigma^2$ represents the variance of the noise ε;

wherein K is a transition covariance matrix that is configured to control how much the adaptive filter coefficients may change from time sample to time sample;

wherein Σ is a prior covariance matrix that is configured to limit the set of available filter coefficient vectors in order to avoid undesirable filter coefficient vectors;

wherein μ is a vector that represents the prior mean of the adaptive filter coefficients that may be configured to limit the set of available filter coefficient vectors in order to avoid undesirable filter coefficient vectors; and wherein $x_n$ is a vector holding the most recent input signal samples.

6. The method according to claim 1, wherein the step of determining the optimum setting of the adaptive filter coefficients comprises the further step of:

using the closed form expression:

$$w_n = Bw_{n-1} + (I - B)\mu + \frac{AX_n^T}{I + X_n A X_n^T}(d - X_n(I - B)\mu - X_n B w_{n-1})$$

wherein $$A = \frac{1}{\sigma_2}(\Sigma^{-1} + K^{-1})^{-1},\ B = \Sigma(K + \Sigma)^{-1}$$

wherein the vector d holds M recent samples of the desired signal, wherein the matrix $X_n$ is defined by M vectors that each holds N recent input signal samples given as:

$$X_n = \begin{bmatrix} x_n & \dots & x_{n-N-1} \\ \vdots & \ddots & \vdots \\ x_{n-M-1} & \dots & x_{n-M-N-2} \end{bmatrix}$$

wherein $\sigma^2$ represents the variance of the noise ε;

wherein K is a transition covariance matrix that is configured to control how much the adaptive filter coefficients may change from time sample to time sample;

wherein Σ is a prior covariance matrix that is configured to limit the set of available filter coefficient vectors in order to avoid undesirable filter coefficient vectors; and wherein μ is a vector that represents the prior mean of the adaptive filter coefficients or may be configured to limit the set of available filter coefficient vectors in order to avoid undesirable filter coefficient vectors.

7. The method according to claim 5, wherein the prior covariance matrix is dense.

8. The method according to claim 5, wherein the transition covariance matrix is dense.

9. The method according to claim 5, comprising the step of:

selecting a specific transition covariance matrix from among a multitude of available transition covariance matrices in dependence on the sound environment or as a function of a user selection, and/or selecting a specific prior covariance matrix from among a multitude of available prior covariance matrices in dependence on the sound environment or as a function of a user selection.

10. The method according to claim 1, wherein the step of determining the optimum setting of the adaptive filter coefficients comprises the further steps of:

deriving an expression for the gradient of the posterior distribution, or for an expression derived from the posterior distribution, with respect to the adaptive filter coefficients;

using a numerical approximation method selected from a group of methods comprising expectation propagation, variational Bayes and Laplace approximation to derive the expression for the gradient; and using an iterative method based on the expression for the gradient in order to determine the optimum setting of the adaptive filter coefficients.

11. The method according to claim 1, wherein the optimum setting of the adaptive filter coefficients is determined on a sample by sample basis whereby the adaptive filter is always operated with the optimum setting.

12. The method according to claim 1, wherein the posterior distribution is the un-normalized distribution.

13. The method according to claim 1, wherein the step of filtering the first set of signal samples is carried out as part of a hearing aid system processing selected from a group consisting of: noise suppression and acoustical feedback suppression.

14. A non-transitory computer-readable storage medium having computer-executable instructions, which when executed carry out a method of operating a hearing aid system having an adaptive filter with N adaptive filter coefficients, said method comprising the steps of:

providing a first set of input signal samples;

providing at least one second signal sample representing a desired signal;

filtering the first set of signal samples in the adaptive filter, in accordance with the formula: $d_n = X_n w_n^T + \varepsilon$, wherein $d_n$ is a vector or a scalar comprising the at least one second signal sample representing the desired signal, wherein $w_n$ is a vector holding the adaptive filter coefficients, wherein $X_n$ is a matrix or a vector comprising the first set of input signal samples, wherein $\varepsilon$ represents noise and wherein n is a time index, selecting a posterior distribution given by $p(w_n | w_{n-1}, d_n)$;

using a closed from expression, determining an optimum setting of the adaptive filter coefficients as the setting that maximizes the posterior distribution; and selecting an optimum setting of the adaptive filter coefficients when updating the adaptive filter.

15. A hearing aid system comprising:

an adaptive filter having N adaptive filter coefficients;

an adaptive filter estimator configured to control the adaptive filter setting by determining the values of the adaptive filter coefficients, wherein the adaptive filter estimator comprises:

a first memory holding a transition covariance matrix;

a second memory holding a prior covariance matrix;

a third memory holding an estimate of a noise standard deviation;

a fourth memory holding a prior mean of the adaptive filter coefficients;

an algorithm that determines the values of the adaptive filter coefficients based on a closed form expression that uses as variables:

a set of samples of a digital input signal;

at least one sample of a digital desired signal, and the contents of the first, second, third and fourth memories, and wherein the closed form expression for determining the values of the adaptive filter coefficients is derived using Bayes rule.

16. The hearing aid system according to claim 15 wherein the closed form expression for determining the values of the adaptive filter coefficients is given as:

$$w_n = Bw_{n-1} + (I - B)\mu + \frac{Ax_n}{1 + x_n^T A x_n}(d_n - x_n^T (I - B)\mu - x_n^T B w_{n-1})$$

wherein $$A = \frac{1}{\sigma_2}(\Sigma^{-1} + K^{-1})^{-1},\ B = \Sigma(K + \Sigma)^{-1}$$

wherein $d_n$ is a digital signal sample representing a desired signal, wherein $x_n$ is a vector holding the most recent input signal samples;

wherein $\mu$ is a vector that represents the prior mean of the adaptive filter coefficients or may be configured to limit the set of available filter coefficient vectors in order to avoid undesirable filter coefficient vectors;

wherein $\sigma^2$ represents a noise estimate of the desired signal;

wherein K is a transition covariance matrix that is configured to control how much the adaptive filter coefficients may change from time sample to time sample, and wherein $\Sigma$ is a prior covariance matrix that is configured to limit the set of available filter coefficient vectors in order to avoid undesirable filter coefficient vectors.

17. The hearing aid system according to claim 15 wherein the closed form expression for determining the values of the adaptive filter coefficients is given as:

$$w_n = Bw_{n-1} + (I - B)\mu + \frac{AX_n^T}{I + X_n A X_n^T}(d - X_n(I - B)\mu - X_n B w_{n-1})$$

wherein $$A = \frac{1}{\sigma_2}(\Sigma^{-1} + K^{-1})^{-1},\ B = \Sigma(K + \Sigma)^{-1}$$

wherein the vector d holds the M recent samples of the desired signal, wherein the matrix $X_n$ holds the M recent vectors of input signal samples as:

$$X_n = \begin{bmatrix} x_n & \cdots & x_{n-N-1} \\ \vdots & \ddots & \vdots \\ x_{n-M-1} & \cdots & x_{n-M-N-2} \end{bmatrix}$$

wherein $\mu$ is a vector that represents the prior mean of the adaptive filter coefficients or may be configured to limit the set of available filter coefficient vectors in order to avoid undesirable filter coefficient vectors;

wherein $\sigma^2$ represents a noise estimate of the desired signal;

wherein K is a transition covariance matrix that is configured to control how much the adaptive filter coefficients may change from time sample to time sample, and wherein Σ is a prior covariance matrix that is configured to limit the set of available filter coefficient vectors in order to avoid undesirable filter coefficient vectors.

18. The hearing aid system according to claim 15, wherein the transition covariance matrix is a dense matrix.

19. The hearing aid system according to claim 15, wherein the prior covariance matrix is a dense matrix.

20. The hearing aid system according to claim 15, wherein the algorithm that determines the values of the adaptive filter coefficients is adapted such that the optimum setting of the adaptive filter coefficients is determined on a sample by sample basis whereby the adaptive filter is always operated with the optimum setting.

21. The hearing aid system according to claim 15, comprising:

a plurality of memories holding a plurality of transition and prior covariance matrices and wherein the algorithm that determines the values of the adaptive filter coefficients is adapted such that a specific transition covariance matrix and/or prior covariance matrix is selected among the given plurality of covariance matrices as a function of a classification of a current sound environment or in response to a user interaction.

22. The hearing aid system according to claim 21, wherein said plurality of memories holding a plurality of transition and prior covariance matrices are accommodated in an external computing device, wherefrom the selected covariance matrices may be uploaded to the hearing aids.

23. The hearing aid system according to claim 15, wherein at least parts of the digital signal processor are accommodated in an external computing device, and wherein the hearing aid system is configured such that samples of the input signal and at least one sample of the desired signal are transferred from a hearing aid and to the external computing device, and optimum adaptive filter coefficients are transferred back to the hearing aid after having been determined in the external computing device.

24. The hearing aid system according to claim 15, wherein the adaptive filter estimator comprises three individual adaptive filter estimators, and wherein the first and second of the three individual adaptive filter estimators each provide an adaptive filter coefficient vector to the third adaptive filter estimator, whereby an improved adaptive filter coefficient vector can be provided from the third adaptive filter estimator and to the adaptive filter.

* * * * *